US005575836A

United States Patent [19]

Sugiura et al.

[11] Patent Number: 5,575,836

[45] Date of Patent: Nov. 19, 1996

[54] ELECTRIC DUST COLLECTOR

[75] Inventors: Sakao Sugiura, Kobe; Osamu Kawabata, Tokyo; Nobuo Teramura, Kobe, all of Japan

[73] Assignee: Mitsubishi Jukogyo Kabushiki Kaisha, Tokyo, Japan

[21] Appl. No.: 360,139

[22] Filed: Dec. 20, 1994

[30] Foreign Application Priority Data

Dec. 28, 1993 [JP] Japan ..... 5-353716
Oct. 15, 1994 [JP] Japan ..... 6-275646

[51] Int. Cl.[6] ..... B03C 3/66

[52] U.S. Cl. ..... 96/82; 95/81; 323/903

[58] Field of Search ..... 95/80, 81; 96/80–82, 96/20–24; 361/235; 323/903

[56] References Cited

U.S. PATENT DOCUMENTS

| | | | |
|---|---|---|---|
| 2,085,758 | 7/1937 | Krutzsch | 96/80 X |
| 2,280,330 | 4/1942 | White | 96/82 |
| 2,704,134 | 3/1955 | White | 96/80 X |
| 3,271,931 | 9/1966 | Taylor | 323/903 X |
| 3,374,609 | 3/1968 | Kide | 96/20 |
| 3,443,358 | 5/1969 | Drenning et al. | 96/80 X |
| 3,643,405 | 2/1972 | Vukasovic et al. | 323/903 X |
| 4,536,698 | 8/1985 | Shevalenko et al. | 323/903 X |
| 4,670,829 | 6/1987 | Dallhammer et al. | 323/903 X |
| 4,772,998 | 9/1988 | Guenther, Jr. et al. | 95/81 X |
| 4,779,182 | 10/1988 | Mickal et al. | 323/903 X |
| 4,808,200 | 2/1989 | Dallhammer et al. | 323/903 X |
| 5,278,492 | 1/1994 | Huynh et al. | 323/903 X |

FOREIGN PATENT DOCUMENTS

| | | | |
|---|---|---|---|
| 565103 | 10/1958 | Canada | 323/903 |
| 0044488 | 1/1982 | European Pat. Off. . | |
| 0093544 | 11/1983 | European Pat. Off. . | |
| 88-07413 | 10/1988 | WIPO | 95/81 |

*Primary Examiner*—Richard L. Chiesa
*Attorney, Agent, or Firm*—Rothwell, Figg, Ernst & Kurz

[57] ABSTRACT

There is provided a capacitor having an end connected to the ground and the other end connected through a secondary winding of a pulse transformer to the discharge electrode. The ground side terminal of the capacitor is connected through a smoothing circuit to a positive voltage side output terminal of a base power supply circuit and a negative voltage side terminal of the base power supply circuit is connected to the discharge electrode side terminal of the capacitor. An output terminal of a pulse power supply circuit is connected to a primary winding of the pulse transformer. The base voltage and the pulse voltage can be controlled independently, and it becomes possible to apply a steep pulse with large output power to the discharge electrode.

8 Claims, 9 Drawing Sheets

ELECTRIC DUST COLLECTOR

BACKGROUND OF THE INVENTION

1. Field of the Invention

The present invention relates to an electric dust collector.

2. Description of the Related Art

An example of a conventional electric dust collector is schematically illustrated in FIG. 7.

In the electric dust collector, as shown in FIG. 7B, a pulse voltage produced by a pulse power supply circuit 142 is superposed on a DC base voltage produced by a base power supply circuit 141 through a coupling capacitor 133 and the superposed voltage is applied to a discharge electrode 130B disposed in a dust collection chamber 130A.

A waveform of the applied voltage is shown in FIG. 7B and has a pulse width of 50 to 200 μs and a pulse frequency of 25 to 400 pps.

Further, in FIG. 7A, numeral 131 denotes a pulse forming capacitor, 132 a switching circuit, 134 a coupling transformer, 135 and 136 an electric power adjustment circuit, 137 and 138 a transformer, and 139 and 140 a rectifier circuit.

FIG. 8A schematically illustrates another conventional electric dust collector.

In the electric dust collector, as shown in FIG. 8A, a DC high voltage produced by a DC high voltage power supply 146 is superposed on a pulse voltage from a pulse forming capacitor 147 without intervention of a coupling capacitor and a discharge electrode 144B disposed in a dust collection chamber 144A is charged with a voltage having a waveform shown in FIG. 8B.

Further, in FIG. 8A, numeral 143 denotes a base voltage supply resistor, 145 a controller, and 148 a switching circuit.

FIG. 9A schematically illustrates still another conventional electric dust collector.

As shown in FIG. 9A, the electric dust collector includes a base power supply circuit 150 and a pulse power supply circuit 152, and a pulse forming capacitor 151 also has the function of a coupling capacitor.

A discharge electrode 153B disposed in a dust collector 153A is charged with a voltage having a waveform shown in FIG. 9B.

Further, in FIG. 9A, numeral 154 denotes a switching circuit.

FIG. 10A schematically illustrates still another conventional electric dust collector.

As shown in FIG. 10A, the electric dust collector includes a pulse generation circuit 164 having a pulse forming capacitor 161 and a high voltage switching circuit 162, and the pulse forming circuit 161 is charged by a DC high voltage power supply 160.

When the voltage at the pulse forming circuit 161 reaches a sufficiently a high value, the switching circuit 162 carries out switching to generate an LC resonance, so that a steep pulse voltage shown in FIG. 10B is superposed on a remaining voltage of a discharge electrode 163B disposed in a dust collection chamber 163A.

Problems of the conventional electric dust collectors are as follows:

In the electric dust collector shown in FIG. 7A;

(1) Since a three-phase AC power is used in the base power supply circuit 141 so as to make the base voltage as smooth as possible, the configuration is complicated, large and expensive.

(2) Further, in order to increase the charging efficiency of the pulse forming capacitor 131, the three-phase AC power is used in the pulse power supply circuit 142, but this results in only a limited improvement in the efficiency.

(3) Since the direction of a base current flowing in a secondary winding of the coupling transformer is the same as that of a pulse current flowing in a primary winding of the coupling transformer 134, the directions of magnetic fluxes generated by the currents are the same. Accordingly, it is necessary to avoid the saturation of the coupling transformer 134 by making the iron core of the coupling transformer 134 extremely large, and a steep pulse having a short pulse width cannot be obtained.

In the electric dust collector shown in FIG. 8A;

(1) Since the single DC high voltage power supply 146 is used and the DC high voltage power supply 146, the switching circuit 148 and the discharge electrode 144B are always connected electrically, the base voltage is apt to be influenced by electric charges of the discharge electrode 144B and is not smoothed.

(2) Since the applied voltage of the pulse forming capacitor 147 is substantially equal to the applied voltage of the dust collection chamber 144A, that is, the base voltage, the peak value of the pulse voltage is influenced by the base voltage, and therefore the base voltage and the pulse voltage cannot be controlled independently. Accordingly, when the pulse voltage is superposed on the base voltage, there is a possibility that abnormal discharge occurs.

(3) Since the energy of the base current generated by the DC high voltage power supply 146 and the resonance current generated by the discharge electrode 144B is consumed by the base voltage supply resistor 143, the resistor 143 has to have a large capacity. In addition, energy losses increase and this is certainly not desirable in view of the saving of energy.

In the electric dust collector shown in FIG. 9A;

(1) The base power supply circuit 150 and the pulse power supply circuit 152 are provided independently, while since an end of the pulse forming capacitor 151 is connected to the discharge electrode 153B, the applied voltage of the pulse forming capacitor 151 is influenced by ripples of the base voltage and accordingly the pulse voltage cannot be controlled independently.

(2) In order to avoid the influence of ripples in the base voltage, it is necessary to increase the base voltage, while when the base voltage is increased, abnormal discharge occurs which is undesirable in view of the dust collection performance.

(3) Since a sum of the base voltage and the pulse voltage is applied to the pulse forming capacitor 151, it is necessary to increase its capacitance in order to increase the maximum allowable voltage of the pulse forming capacitor 151 and increase the peak voltage of the pulse upon switching.

In the electric dust collector shown in FIG. 10A;

(1) Since the switching function and the insulation function are provided in the pulse generation circuit 164, the pulse voltage can be controlled independently. However, since the base power supply is not provided, the base voltage cannot be controlled during the non-pulse period.

(2) Since the resonance current flows during the period when the switching circuit 162 is on, the pulse voltage being attenuated is applied to the discharge electrode 163B plural times, and accordingly the pulse frequency cannot be controlled exactly.

(3) The energy of the resonance current is mainly consumed in the dust collection chamber 163A. However, since a plurality of pulses are applied, more energy is consumed as compared with a single pulse. This is not desirable in view of the dust collection performance.

SUMMARY OF THE INVENTION

In order to solve the above problems, according to an aspect of the present invention, an electric dust collector which superposes a pulse voltage of negative polarity produced by a pulse power supply circuit on a base voltage of negative polarity produced by a base power supply circuit so that both voltages are added to each other in the same direction of polarity and which supplies the superposed voltage to a discharge electrode of negative polarity disposed in a dust collection chamber connected to ground, is characterized by the provision of a capacitor having one end connected to the ground and the other end connected through a secondary winding of a pulse transformer to the discharge electrode, a positive voltage side output terminal of the base power supply circuit being connected to the ground side terminal of the capacitor, a negative voltage side output terminal of the base power supply circuit being connected through a smoothing circuit to the discharge electrode side terminal of the capacitor, an output terminal of the pulse power supply circuit being connected to a primary winding of the pulse transformer.

According to another aspect of the present invention, the pulse power supply circuit comprises a series discharge circuit including a switching element, a saturable reactor, and a pulse capacitor which is charged by a DC source and which supplies a pulse-like discharge current to the primary winding of the pulse transformer, and a semiconductor element which is connected in parallel to the switching element and allows a current only in a direction reverse to that of the discharge current, wherein the switching element comprises a semiconductor element capable of being controlled to be turned on and off by a conductive control signal supplied to a control terminal of the semiconductor element.

According to still another aspect of the present invention, the pulse power supply circuit comprises a converter circuit for converting an AC voltage into a DC voltage, an invertor circuit for converting the converted DC voltage into a desired high-frequency AC voltage, a transformer for boosting the high-frequency AC voltage, a rectifier for rectifying the boosted high-frequency AC voltage, and a pulse capacitor which is charged with the rectified DC voltage and which supplies a pulse-like discharge current to the primary winding of the pulse transformer.

According to still another aspect of the present invention, the above-described electric dust collector is further characterized in that the pulse power supply circuit comprises a series discharge circuit including a switching element, a saturable reactor, and a pulse capacitor which is charged by a DC source and which supplies a pulse-like discharge current to the primary winding of the pulse transformer, and a first switch for turning on and off a supply path of a conductive control signal supplied to a control terminal of the switching element; and the base power supply circuit comprises reverse-blocking triode thyristors arranged in parallel with each other in the reverse direction between an AC power supply and a transformer, a second switch for switching a conductive control signal supplied to control terminals of the thyristors over to a continuous charging signal or an intermittent charging signal, and a rectifier for rectifying an AC voltage boosted by the transformer; wherein a third switch is provided for connecting the negative voltage side output terminal of the base power supply circuit to the discharge electrode to the discharge electrode either through the smoothing circuit, the capacitor, and the secondary winding of the pulse transformer to the negative voltage side output terminal of the base power supply circuit or directly by bypassing the smoothing circuit, the capacitor and the secondary winding of the pulse transformer.

According to still another aspect of the present invention, the pulse power supply circuit comprises a series discharge circuit including a switching element having a semiconductor element capable of being controlled to be turned on and off by a conductive control signal supplied to a control terminal thereof, a saturable reactor, and a pulse capacitor which is charged by a DC source and which supplies a pulse-like discharge current to said primary winding of the pulse transformer, a semiconductor element which is connected in parallel to the switching element and allows a current only in a direction reverse to that of the discharge current, and a first switch for turning on and off a supply path of the conductive control signal supplied to the control terminal of the switching element; and the base power supply circuit comprises reverse-blocking triode thyristors arranged in parallel with each other in the reverse direction between an AC power supply and a transformer, a second switch for switching the conductive control signal supplied to control terminals of the thyristors over to a continuous charging signal or an intermittent charging signal, and a rectifier for rectifying an AC voltage boosted by the transformer; wherein a third switch is provided for connecting the negative voltage side output terminal of the base power supply circuit to the discharge electrode either through the smoothing circuit, the capacitor and the secondary winding of the pulse transformer or directly by bypassing the smoothing circuit, the capacitor and the secondary winding of the pulse transformer.

According to still another aspect of the present invention, the DC source includes a rectifier for rectifying a high-frequency AC voltage which is converted into a desired high-frequency voltage by the converter circuit and the invertor circuit and boosted by the transformer.

In the present invention, when the AC electric power from the AC power supply is supplied to the base power supply circuit, the electric power is regulated by the reverse-blocking triode thyristors and the regulated voltage is boosted by the transformer. Then, the boosted voltage is rectified by the rectifier, so that the base voltage is produced. The base voltage is smoothed by the smoothing circuit and is then supplied across the capacitor. At the same time, the negative voltage produced at the negative voltage side output terminal of the smoothing circuit is supplied through the secondary winding of the pulse transformer to the discharge electrode.

On the other hand, when the AC electric power from the AC power supply is supplied to the pulse power supply circuit, the electric power is converted into DC voltage in the converter circuit and is then converted into a high-frequency AC voltage in the invertor circuit. The AC voltage is boosted by the transformer and after the boosted voltage is rectified, the rectified voltage is applied to the pulse capacitor through the saturable reactor.

When the switching element is turned on, the pulse-like current discharged from the pulse capacitor flows through the primary winding of the pulse transformer via the saturable reactor and the switching element, and the pulse voltage of negative polarity induced on the basis of the pulse-like current is superposed on the base voltage of negative polarity supplied to the secondary winding of the pulse transformer, so that both voltages are added to each other in the same direction of polarity to be applied to the discharge electrode, so that corona discharge occurs in the duct collection chamber.

Thereafter, electric charges accumulated in the dust collection chamber are discharged from the discharge electrode by the LC resonance, and the resonance current is transmitted from the secondary winding to the primary winding of the pulse transformer. Then, the current is withdrawn into the pulse capacitor through the semiconductor element and the saturable reactor.

The conductive control signal supplied to the control terminal of the switching element is turned on or off by the first switch, and the conductive control signal supplied to the control terminal of the thyristor is switched over to the continuous charging signal or the intermittent charging signal by way of the second switch. In addition, the third switch can be switched to connect the negative voltage side output terminal of the base power supply circuit to the discharge electrode either through the smoothing circuit, the capacitor and the secondary winding of the pulse transformer or directly by bypassing the smoothing circuit, the capacitor and the secondary winding of the pulse transformer, so that various modes of the pulse charging, the perfect DC charging, the intermittent charging, and the DC ripple charging can be selected.

According to the present invention, there is provided the capacitor having one end connected to the ground and the other end connected through the secondary winding of the pulse transformer to the discharge electrode and the positive voltage side output terminal of the base power supply circuit is connected to the ground side terminal of the capacitor. The negative voltage side output terminal of the base power supply circuit is connected through the smoothing circuit to the discharge electrode side terminal of the capacitor and the output terminal of the pulse power supply circuit is connected to the primary winding of the pulse transformer. Accordingly, the base voltage can be smoothed and the base voltage and the pulse voltage can be controlled independently. Also, a steep pulse with large output power can be generated by the discharge electrode with the compact pulse transformer.

Further, in another aspect of the present invention, the pulse power supply circuit comprises the series discharge circuit including the switching element, the saturable reactor, and the pulse capacitor which is charged by the DC source and which supplies the pulse-like discharge current to the primary winding of the pulse transformer, and the semiconductor element which is connected in parallel to the switching element and allows a current only in the direction reverse to that of the discharge current. The switching element comprises the semiconductor element capable of being controlled to be turned on and off by the conductive control signal supplied to the control terminal thereof, the resonance current which reversely flows from the discharge electrode to the pulse power supply circuit can be withdrawn into the pulse capacitor. According to such configuration, the energy utilization can be improved and the pulse frequency applied to the discharge electrode can be controlled exactly.

In addition, according to still another aspect of the invention, the pulse power supply circuit comprises the converter circuit for converting the AC voltage into the DC voltage, the invertor circuit for converting the converted DC voltage into the desired high-frequency AC voltage, the transformer for boosting the high-frequency AC voltage, the rectifier for rectifying the boosted high-frequency AC voltage, and the pulse capacitor which is charged with the rectified DC voltage and which supplies the pulse-like discharge current to the primary winding of the pulse transformer. According to such configuration, the charging efficiency and the charging speed of the pulse capacitor can be improved.

Furthermore, the pulse power supply circuit may comprise the series discharge circuit including the switching element, the saturable reactor, and the pulse capacitor which is charged by the DC source and which supplies the pulse-like discharge current to the primary winding of the pulse transformer, and the first switch for turning on and off the supply path of the conductive control signal supplied to the control terminal of the switching element. Also, the base power supply circuit may comprise reverse-blocking triode thyristors arranged in parallel with each other in the reverse direction between the AC power supply and the transformer, the second switch for switching the conductive control signal supplied to control terminals of the thyristors over to the continuous charging signal or the intermittent charging signal, and the rectifier for rectifying the AC voltage boosted by the transformer. In addition, there is provided the third switch for connecting the negative voltage side output terminal of the base power supply circuit to the discharge electrode either through the smoothing circuit, the capacitor and the secondary winding of the pulse transformer or directly by bypassing the smoothing circuit, the capacitor and the secondary winding of the pulse transformer. Accordingly, since any of various modes including the pulse charging, the perfect DC charging, the intermittent charging, and the DC ripple charging can be selected, the dust collection performance can be improved irrespective of variations in the electric resistivity of dust present in the gas being processed, and the power consumption can be reduced.

BRIEF DESCRIPTION OF THE DRAWINGS

FIG. 6A shows the pulse charge mode, FIG. 6B the perfect DC charge mode, FIG. 6C the intermittent charge mode, and FIG. 6D the DC ripple charge mode;

DETAILED DESCRIPTION OF THE PREFERRED EMBODIMENT

Figure 1:
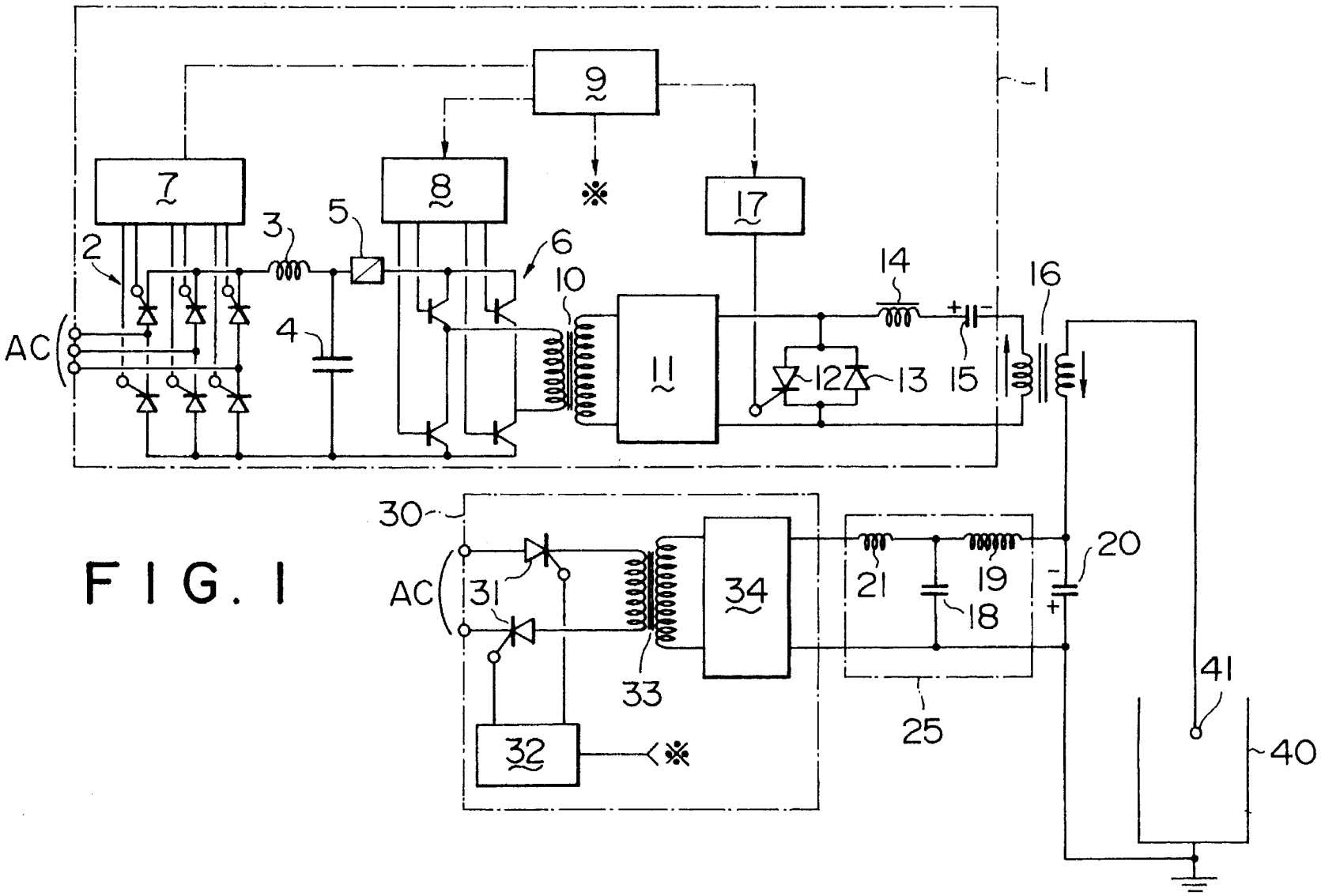
FIG. 1 is a schematic diagram illustrating a first embodiment of the present invention.
Figure 2:
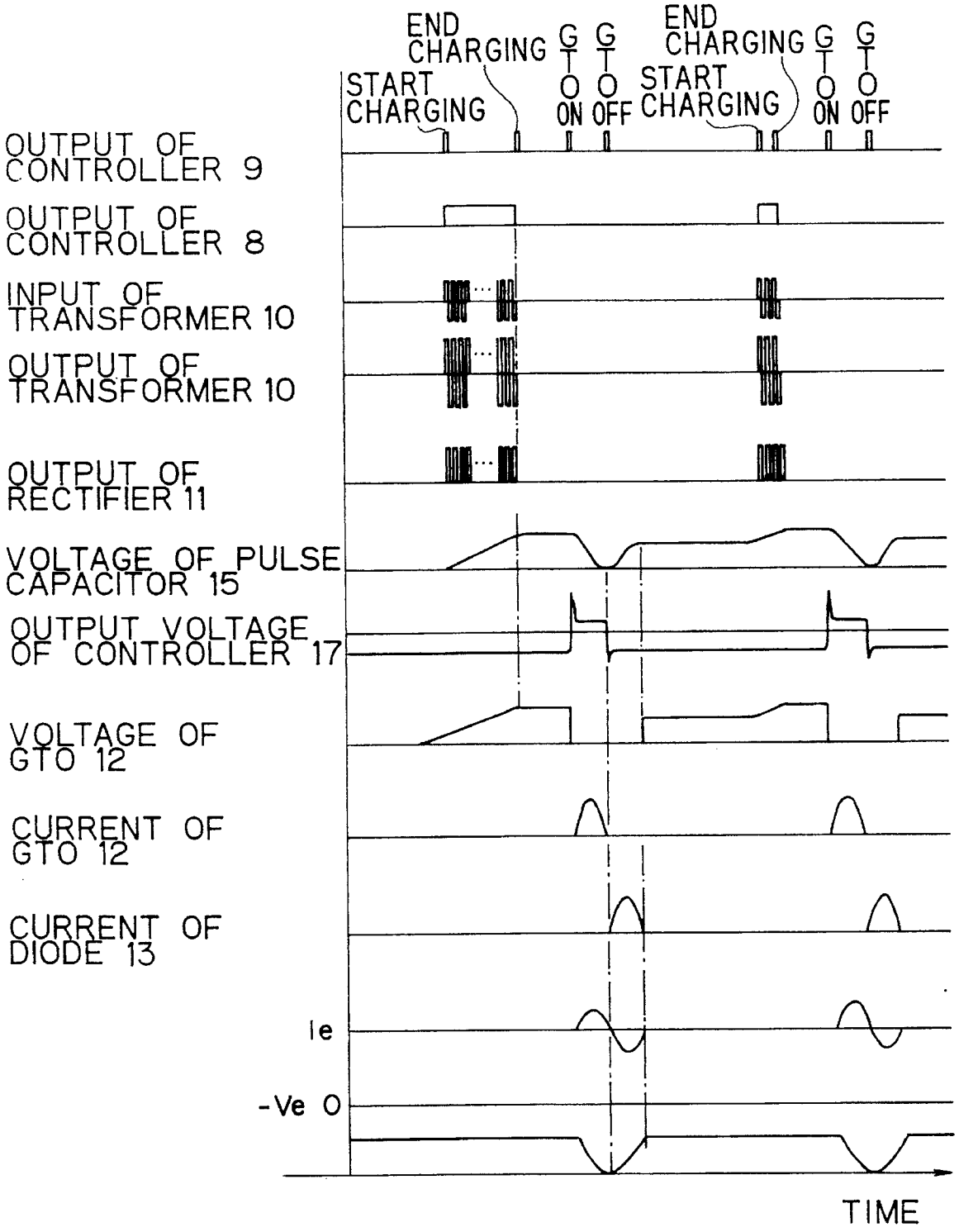
FIG. 2 is a timing chart showing operation of the pulse power supply circuit in the first embodiment.

An embodiment of the present invention is schematically illustrated in FIGS. 1 and 2.

In FIG. 1, numeral 30 denotes a base power supply circuit, which includes a pair of reverse-blocking triode thyristors 31 (hereinafter referred to as thyristors) which are arranged in parallel with each other in the reverse direction, a transformer 33, a rectifier 34 and a controller 32.

When AC electric power from an AC power supply is supplied to the base power supply circuit, the electric power is regulated so that a desired base voltage is obtained by the thyristors 31.

More particularly, a conductive control signal (continuous charging signal or intermittent charging signal) from the controller 32 is supplied to control terminals of the thyristors 31 and the firing time, that is, the conductive time of the thyristors 31 is controlled to thereby regulate a current and a voltage, that is, the electric power.

The conductive control signal is now described in detail. When the thyristors 31 are fired with a given firing angle (conductive angle) at every half period of the AC power supply frequency (charge rate=1), such operation is called continuous charging. When the thyristors 31 are fired with a given firing angle once in each full period of the AC supply frequency (charge rate=½) or once in one and a half periods (charge rate=⅓) of the AC power supply frequency, such operation is called intermittent charging.

Accordingly, in the case of the conductive control signal having the firing angle of 60° and the charge rate of ⅓, for example, the thyristors 31 are operated repeatedly so that the thyristors 31 are fired (turned on) at 60° for a half period, are not fired during the next full period (a half period times two), and are fired again at 60° for a next half period.

The firing angle and the charge rate can be freely set and changed by the controller 32.

The AC current regulated by the thyristors 31 is boosted by the transformer 33 and is then rectified by the rectifier 34.

An output of the rectifier 34 is smoothed into a substantially perfect DC voltage by a smoothing circuit 25 composed of a smoothing capacitor 18 and reactors 19 and 21 and is applied across a capacitor 20.

A positive polarity side terminal of the capacitor 20 is connected to ground and a negative polarity side terminal of the capacitor 20 is connected through a secondary winding of a pulse transformer 16 to a discharge electrode 41, so that the discharge electrode 41 is charged with a negative voltage.

On the other hand, a pulse power supply circuit 1 includes a converter circuit 2, a reactor 3, a capacitor 4, a fuse 5, an invertor circuit 6 constituted by a transistor bridge, a transformer 10, a rectifier 11, a GTO thyristor (gate turn-off thyristor: switching element) 12, a diode (semiconductor element) 13, a saturable reactor 14, a pulse capacitor 15, and controllers 7, 8, 9 and 17. The base power supply circuit 30 is insulated from the discharge electrode 41 by means of the pulse transformer 16.

When a three-phase AC voltage from an AC power supply is supplied to the pulse power supply circuit 1, the voltage is converted into pulsating flow by the converter circuit 2 on the basis of a signal from the controller 7 and is then smoothed by the reactor 3. The smoothed voltage from the reactor 3 is applied to the capacitor 4.

The DC voltage from the capacitor 4 is converted into a desired high-frequency AC voltage by the invertor circuit 6 on the basis of a signal from the controller 8, and the AC voltage is then boosted by the transformer 10. Thereafter, the boosted voltage is rectified by the rectifier 11, and the rectified voltage is then applied to the pulse capacitor 15 through the saturable reactor 14.

At this time, the GTO thyristor 12 is off in response to a command from the controller 17.

The voltage of the pulse capacitor 15 is detected by a voltmeter (not shown). When a signal indicating that the pulse capacitor 15 is charged to a predetermined voltage is inputted to the controller 9, the signal from the controller 8 is turned off by a command from the controller 9.

Thereafter, when the GTO thyristor 12 is supplied with an ON command, that is, the conductive control signal from the controller 17, the GTO thyristor 12 is turned on to discharge the pulse capacitor 15 so that the discharge current flows from the pulse capacitor 15 through the saturable reactor 14 and the GTO thyristor 12 (series discharge circuit) to the primary winding of the pulse transformer 16.

Consequently, a pulse voltage of negative polarity is generated in the secondary winding of the pulse transformer 16 and is superposed on the base voltage of the negative polarity which is always supplied to the secondary winding so that the two voltages are added to each other in the same direction of polarity to form a voltage Ve and a current Ie which are applied to the discharge electrode 41.

The direction of the discharge current flowing through the primary winding of the pulse transformer 16 from the lower end to the upper end is reverse to that of the base current flowing through the secondary winding thereof from the upper end to the lower end.

When a saturation time of the saturable reactor 14 elapses after the voltage Ve supplied to the discharge electrode 41 reaches a peak value, electric charges stored in the dust collection chamber 40 are discharged from the discharge electrode 41 by the LC resonance as a resonance current of a direction reverse to the above direction.

The current is transmitted from the secondary winding to the primary winding of the pulse transformer 16 and flows into the pulse capacitor 15 through the diode 13 connected in parallel to the GTO thyristor 12 in the reverse direction with respect to the directionality of the thyristor 12, and the saturable reactor 14.

By turning off the GTO thyristor 12 with a command from the controller 17 until the resonance current finishes flowing after the voltage Ve reaches the peak value, electric charges flowing into the pulse capacitor 16 are recovered in the pulse capacitor 16 without being discharged again as the resonance current.

The controller 9 supplies signals to the controllers 7, 8 and 17 and the ON/OFF timings of the converter circuit 2, the invertor circuit 6 and the GTO thyristor 12 are controlled by the controller 9.

The controller 9 is interlocked with the controller 32 of the base power supply circuit 30 and the pulse power supply circuit 1 cooperates with the base power supply circuit 30 in operation.

The timing chart showing operation of the pulse power supply circuit 1 is shown in FIG. 2.

Thus, since the pulse power supply circuit 1 is insulated from the base power supply circuit 30 and the discharge electrode 41, and the base voltage is converted into the substantially perfect DC voltage by the smoothing circuit 25, the base voltage and the pulse voltage can be controlled quite independently. Accordingly, when the pulse voltage is superposed onto the base voltage, there is no possibility that abnormal discharge occurs.

Further, when the capacitance of the smoothing circuit 25 is made larger than that of the dust collection chamber 40 (about ten times), the above effect is more pronounced.

In addition, the direction of the pulse current flowing through the primary winding of the pulse transformer 16 is reversed to that of the base current flowing through the secondary winding of the transformer and the directions of magnetic fluxes produced in the pulse transformer 16 by both currents are reversed to prevent the saturation of an iron core of the pulse transformer 16. Accordingly, a steeply pulsed voltage having large output power can be obtained even with a compact pulse transformer.

Further, because the resonance current flowing reversely from the discharge electrode 41 to the pulse power supply circuit 1 is taken in the closed circuit composed of the primary winding of the pulse transformer 16, the diode 13, the saturable reactor 14, and the pulse capacitor 15, and also because it is recovered into the pulse capacitor 15, the utilization of energy can be improved and at the same time the pulse frequency applied to the discharge electrode 41 can be controlled exactly.

In addition, since the desired high-frequency AC voltage is produced after the AC voltage is converted into the DC voltage once by the converter circuit 2 and the invertor circuit 6, the charge efficiency to the pulse capacitor 15 can be improved.

Furthermore, since the pulse capacitor 15 is controlled to be turned on and off by the GTO thyristor 12, the pulse width can be controlled on the order of several tens of microseconds (several 10 μs).

A second embodiment of the present invention is now described with reference to FIGS. 3 to 6.

Figure 3:
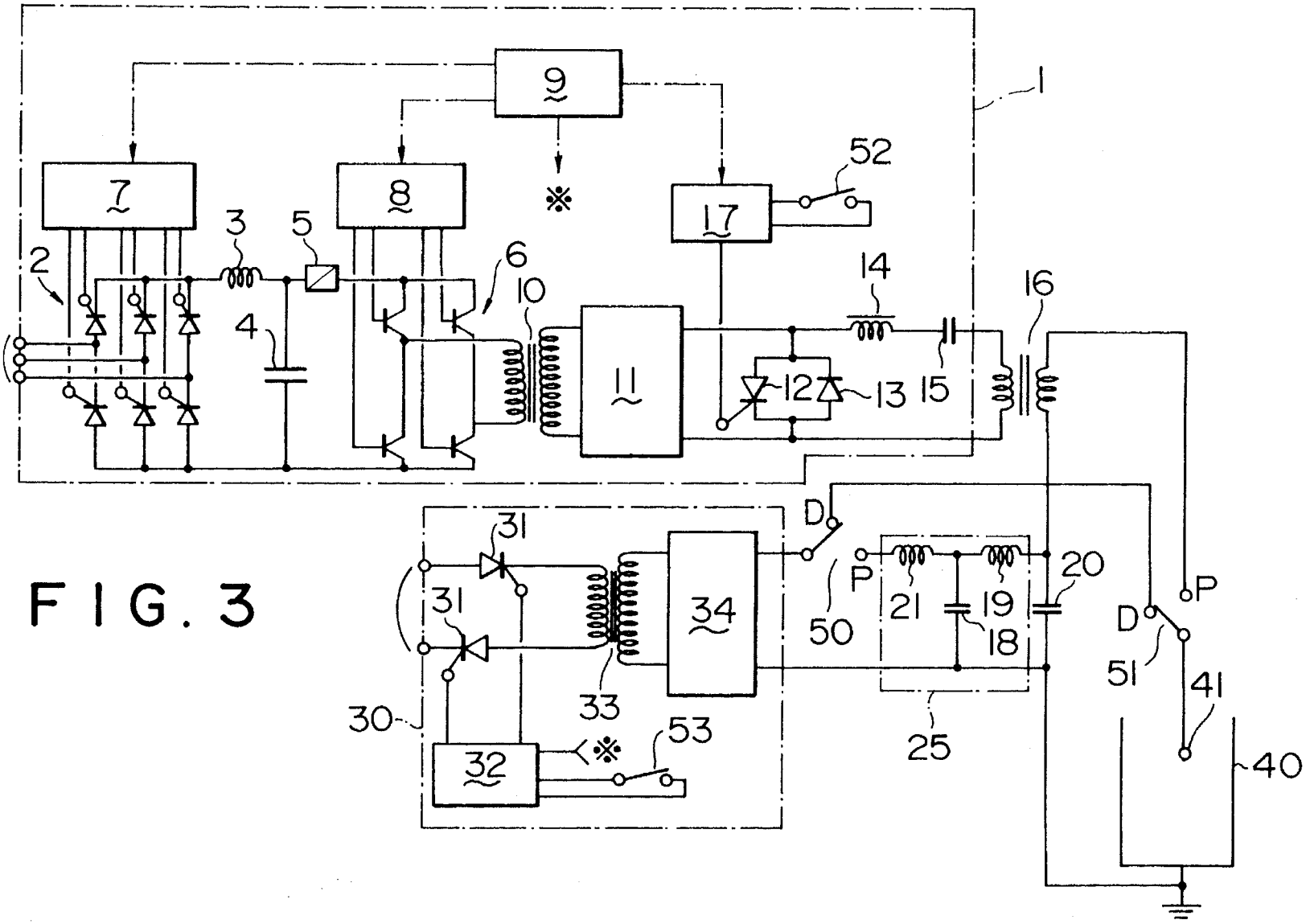
FIG.3 is a schematic diagram illustrating a second embodiment of the present invention.

In FIG. 3, numeral 52 denotes a first switch for switching a supply path of the conductive control signal outputted by the controller 9 to the GTO thyristor 12. When the switch 52 is on, the GTO thyristor 12 is turned on or off by the conductive control signal from the controller 17, while when the switch is off, the thyristor 12 is not turned on and is always non-conductive even when the conductive control signal is outputted from the controller 9.

Numeral 53 denotes a second switch for switching the conductive control signal supplied to the thyristor 31 over to the continuous or intermittent charging signal. When the switch 53 is on, the conductive control signal is switched to the intermitting charging signal, and when the switch 53 is off, the conductive control signal is changed over to the continuous charging signal.

Figure 4:
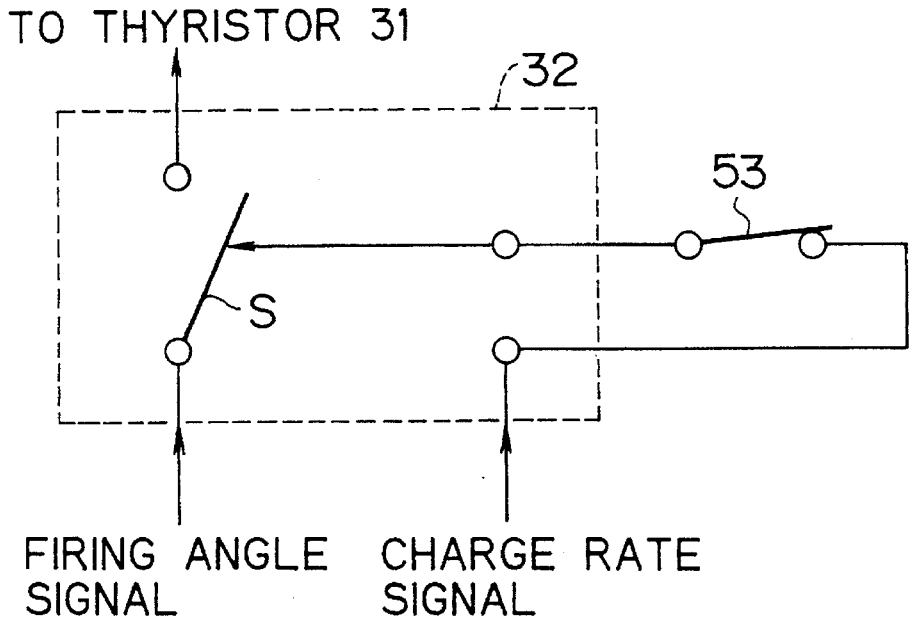
FIG. 4 is a schematic diagram illustrating an example of a switching mechanism of the firing angle signal and the charge rate signal in the second embodiment.

FIG. 4 schematically illustrates the changing-over mechanism.

A firing angle signal and a charge rate signal are supplied to the controller 32 externally and a switch S is switched by the charge rate signal.

More particularly, the firing angle signal is supplied to the thyristor 31 through the switch S which is always on, while when the charge rate is, for example, ⅓, the switch S is turned off by the charge rate signal during a full period (a half period×2) during which the thyristor 31 is not fired and charging is suspended.

Accordingly, when the switch 53 is on, the conductive control signal produced by the controller 32 is the intermittent charging signal having a certain firing angle. On the other hand, when the switch 52 is off, the charge rate signal for switching the switch S is cut off. Then, the switch S is left on, and the conductive control signal outputted from the controller 32 is the continuous charging signal having a certain firing angle.

Numerals 50 and 51 denote third switches which are interlocked with each other. When the switches are switched from the P side to the D side, the secondary winding of the pulse transformer 16 and the discharge electrode 41 are separated from each other from the state shown in FIG. 1, and the discharge electrode 41 bypasses the secondary winding of the pulse transformer 16 and the smoothing circuit 25 and is directly connected to the negative voltage side output terminal of the base power supply circuit 30.

Other parts are configured in the same way as in FIG. 1. Corresponding elements are designated by the same numerals, and their descriptions are omitted.

In the electric dust collector of this type, with an increase in the electric resistivity of dust contained in processing gas of the dust collection chamber 40, the charging condition is successively changed to be normal charging, frequent occurrence of sparks, reverse ionization at a relatively high voltage, and reverse ionization at a low voltage and with a large current.

Accordingly, if the charge mode is switched in the order of DC ripple charging, perfect DC charging, intermittent charging, and pulse charging in accordance with change of the charging condition, and thus the dust collection performance is improved.

When the third switches 50 and 51 are connected to the P side and the first switch 52 is on, the base voltage produced by the base power supply circuit 30 is smoothed through the switch 50 and the smoothing circuit 25, and then supplied to the discharge electrode 41 through the secondary winding of the pulse transformer 16. Since the first switch 52 is on, the GTO thyristor 12 is switched by the conductive control signal from the controller 17. The pulse current is thus produced. The pulse voltage induced in the secondary winding of the pulse transformer 16 when this pulse current flows through the primary winding of the pulse transformer 16 is superposed on the base voltage. The superposed voltage is applied to the discharge electrode 41 of the dust collection chamber 40, and the pulse charge mode is attained.

Figure 6A:
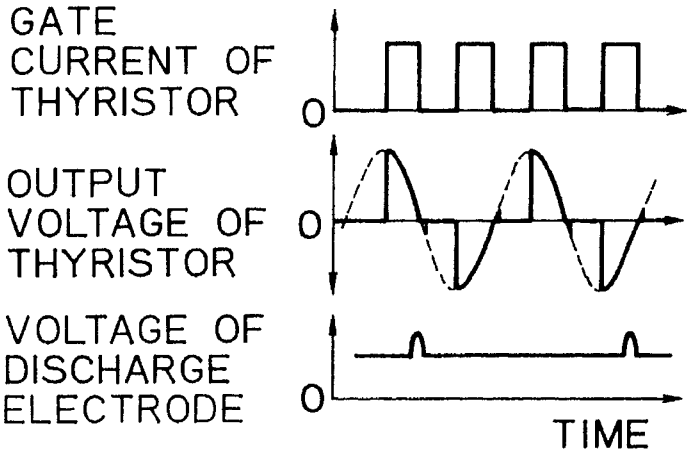
FIGS. 6A–6D are timing charts showing the gate current and the output voltage of the thyristor and the voltage of the discharge electrode in the second embodiment.

FIG. 6A is a timing chart showing a gate current and an output voltage of the thyristor 31 and a voltage of the discharge electrode 41 in the pulse charge mode.

Since the voltage application time can be adjusted on the order of microseconds in the pulse charge mode, the pulse charge mode is effective for the reverse ionization having a very short time constant. Since the voltage application time is very short, the power consumption can be reduced greatly.

When the first switch 52 is turned off while the third switches 50 and 51 are left to the P side, the supply path of the conductive control signal to the GTO thyristor 12 is cut off, so that the GTO thyristor 12 is not turned on and the pulse capacitor 15 is not discharged. Accordingly, the pulse voltage is not produced.

On the other hand, the base voltage produced by the base voltage circuit 30 is supplied to the discharge electrode 41 through the smoothing circuit 25.

Accordingly, the base voltage supplied to the discharge electrode 41 has a waveform in which ripples are removed by the smoothing circuit 25 and the so-called perfect DC charge mode is attained.

Figure 6B:
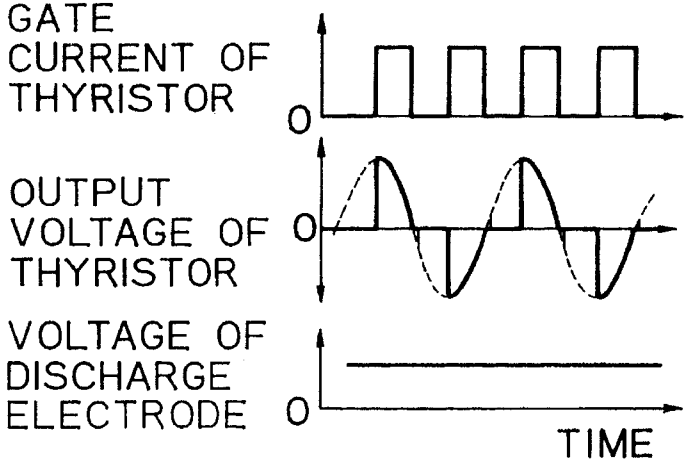

FIG. 6B is a timing chart showing the gate current and the output voltage of the thyristor 31 and the voltage of the discharge electrode 41 in the perfect DC charge mode.

Since there are no ripples in the perfect DC charge mode, the occurrence of spark discharge can be suppressed even under the conditions in which sparks occur frequently.

When the third switches 50 and 51 are both switched to the D side and the second switch 53 is turned on, the discharge electrode 41 is directly connected to the base power supply circuit 30 and the intermittent charging signal is produced by the controller 32, so that the thyristors 31 are turned on with given firing angle and charge rate. In this case, the base voltage supplied to the discharge electrode 41 has a waveform having a peak value while the thyristors 31 are conductive and the so-called intermittent discharge mode is attained.

Figure 6C:
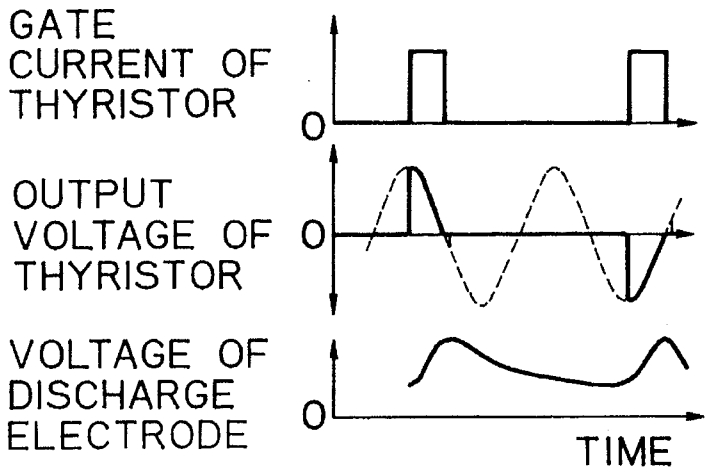

FIG. 6C is a timing chart showing the gate current and the output voltage of the thyristor 31 and the voltage of the discharge electrode 41 in the intermittent charge mode.

In the intermittent charge mode, the voltage application time can be adjusted in the order of millisecond. Accordingly, it is effective for the reverse ionization of a short time constant of occurrence and since the voltage application time is short, the power consumption can be reduced.

When the second switch 53 is turned off while the third switches 50 and 51 are left to the D side, the charge rate signal for switching the switch S of FIG. 4 is cut off, and accordingly the continuous charge signal with a given firing angle is produced by the controller 32.

Thus, the base voltage supplied to the discharge electrode 41 has a waveform having ripple and the so-called DC ripple charge mode is attained.

Figure 6D:
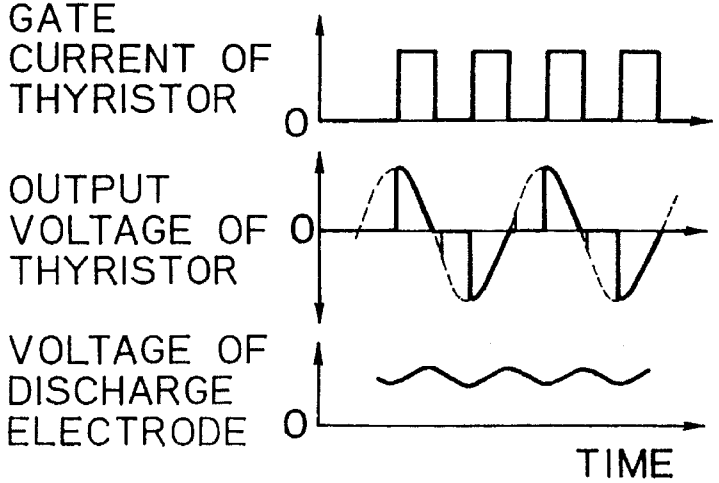
Figure 7A:
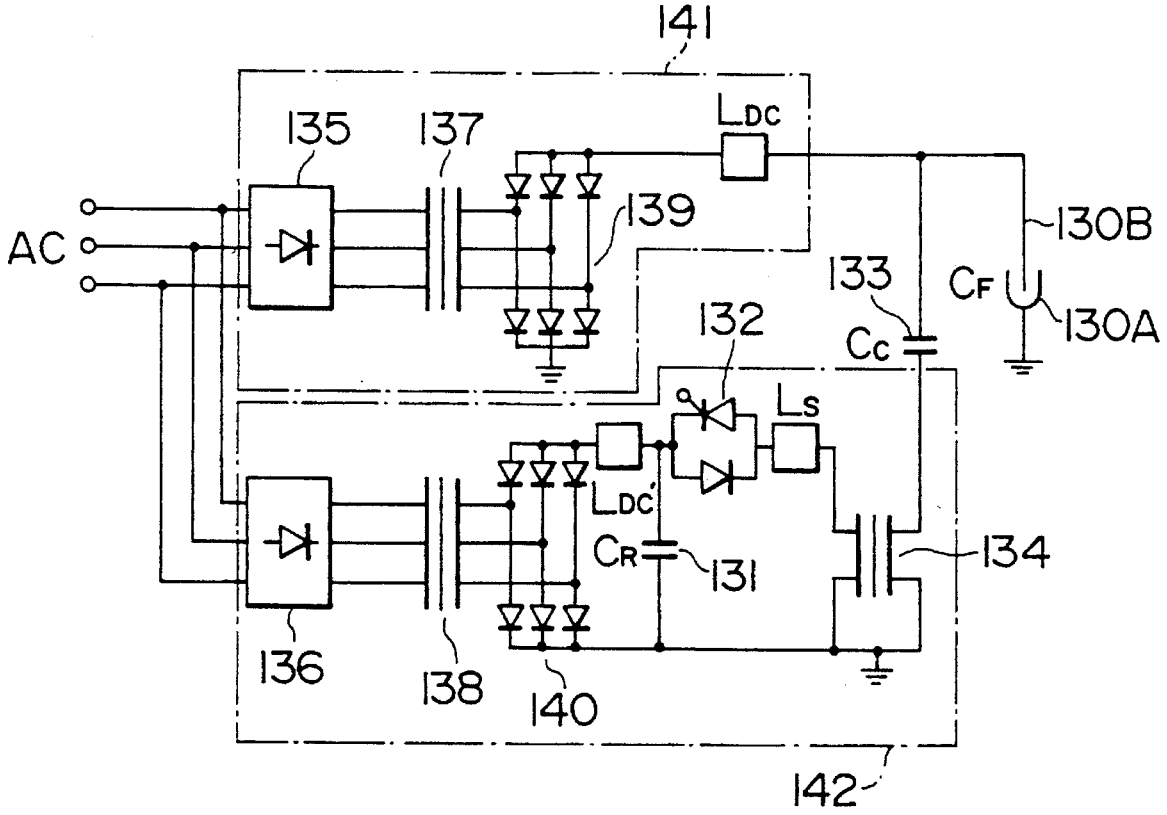
FIG. 7A CONVENTIONAL ART
FIGS. 7A is a schematic diagram illustrating an example of a conventional electric dust collector.
Figure 7B:
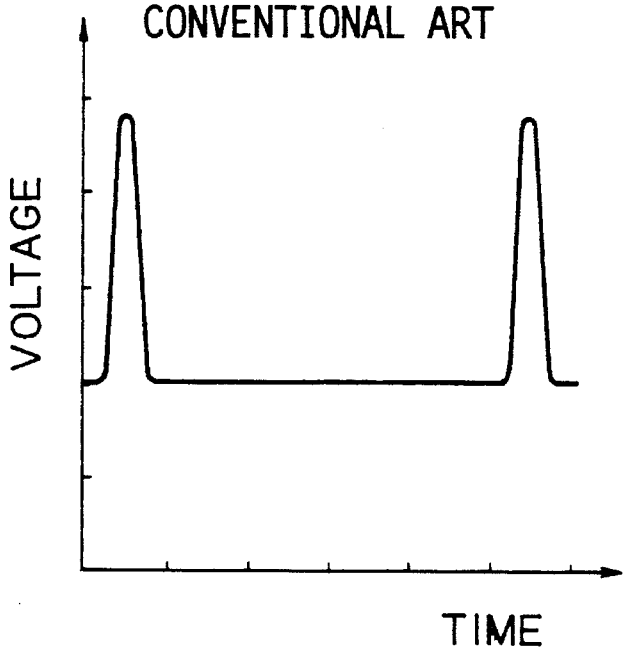
FIG. 7B CONVENTIONAL ART
FIG. 7B is an output waveform diagram therefor.
Figure 8A:
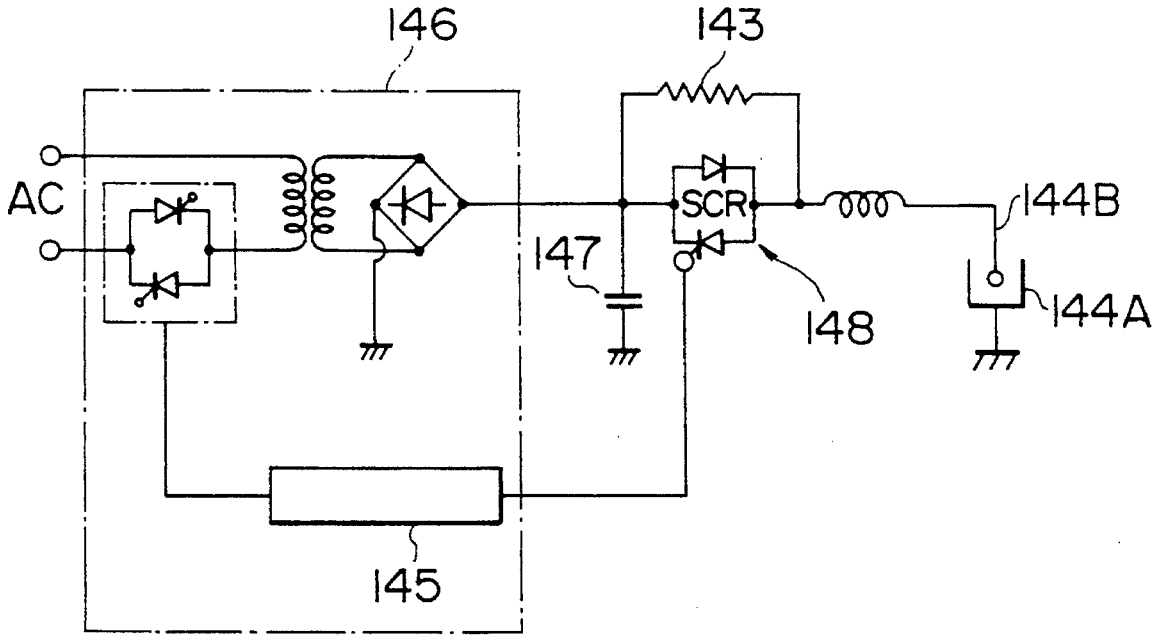
FIG. 8A CONVENTIONAL ART
FIG. 8A is a schematic diagram illustrating another example of a conventional electric dust collector.
Figure 8B:
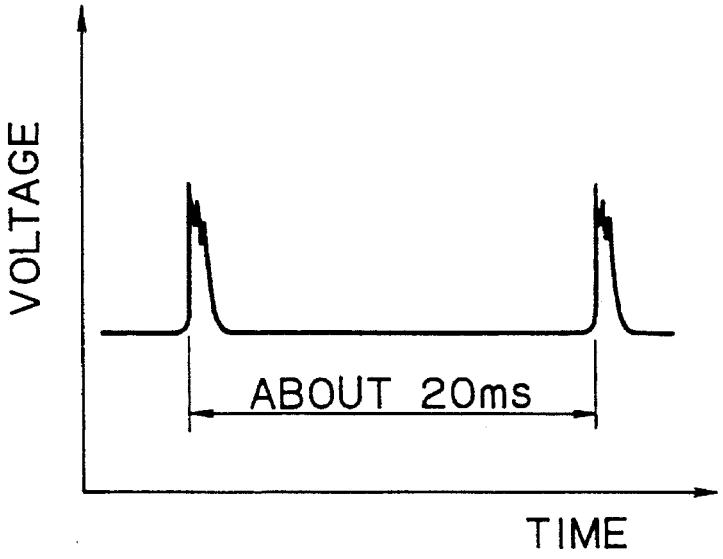
FIG. 8B CONVENTIONAL ART
FIG. 8B is an output waveform diagram therefor.
Figure 9A:
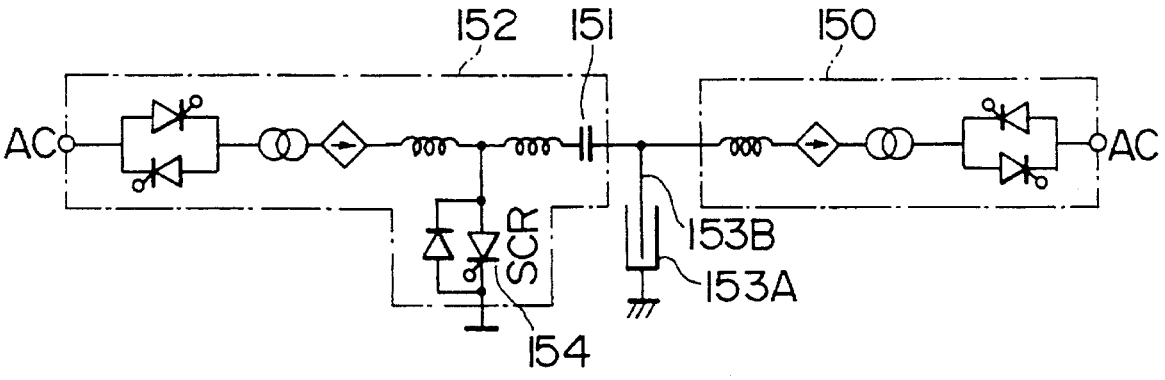
FIG. 9A CONVENTIONAL ART
FIG. 9A is a schematic diagram illustrating still another example of a conventional electric dust collector.
Figure 9B:
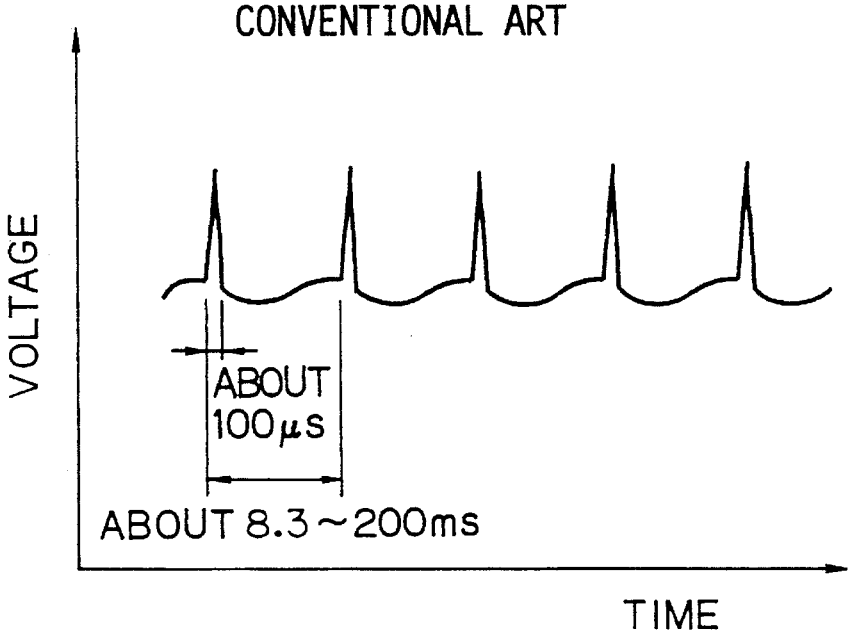
FIG. 9B CONVENTIONAL ART
FIG. 9B is an output waveform diagram therefor.
Figure 10A:
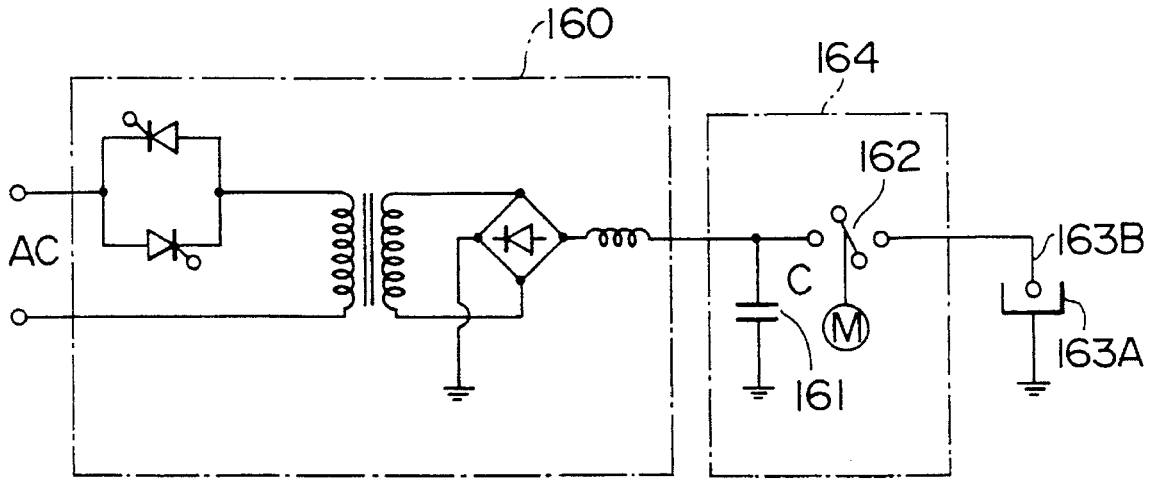
FIG. 10A CONVENTIONAL ART
FIG. 10A a schematic diagram illustrating still another example of a conventional electric dust collector.
Figure 10B:
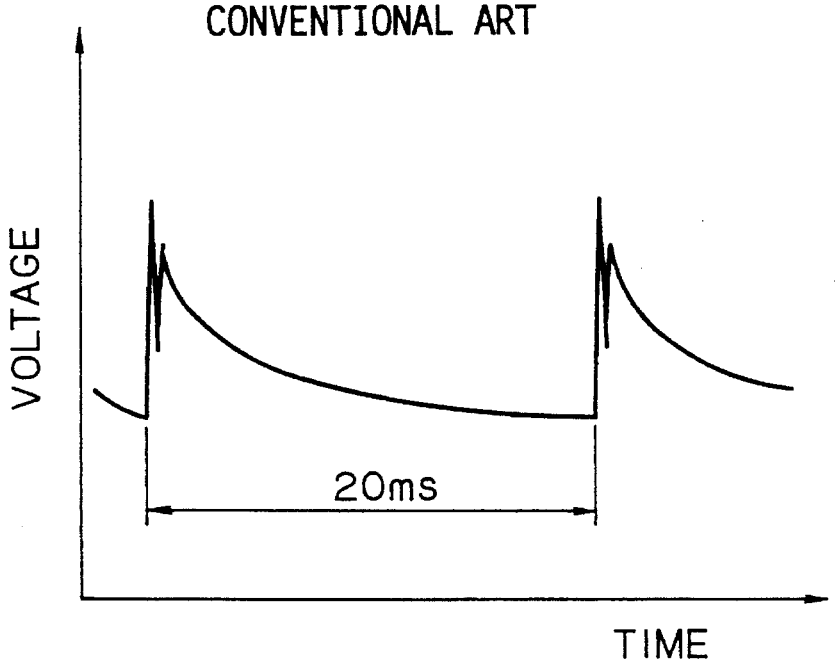
FIG. 10B CONVENTIONAL ART
FIG. 10B is an output waveform diagram.

FIG. 6D is a timing chart showing the gate current and the output voltage of the thyristor 31 and the voltage of the discharge electrode 41 in the DC ripple charge mode.

The DC ripple charge mode is a conventional charging method which has been used satisfactorily. In the DC ripple charge mode, analysis of characteristics is easy and the dust collection performance is good under normal charge conditions.

Further, when switching modes, the firing angle and the charge rate are set in the controller 32, so that the voltage supplied to the discharge electrode 41 becomes a predetermined value.

As described above, since the operation can be switched to the pulse charge mode, the perfect DC charge mode, the intermittent charge mode and the DC ripple charge mode by changing over of the switches 50, 51 and 52, the optimum charge mode can be selected in accordance with the charge condition (normal, with frequent occurrence of spark discharges, and with reverse ionization) varied due to the electric resistivity of dust contained in the processing gas, so that the dust collection performance can be improved and the power consumption can be reduced.

Figure 5:
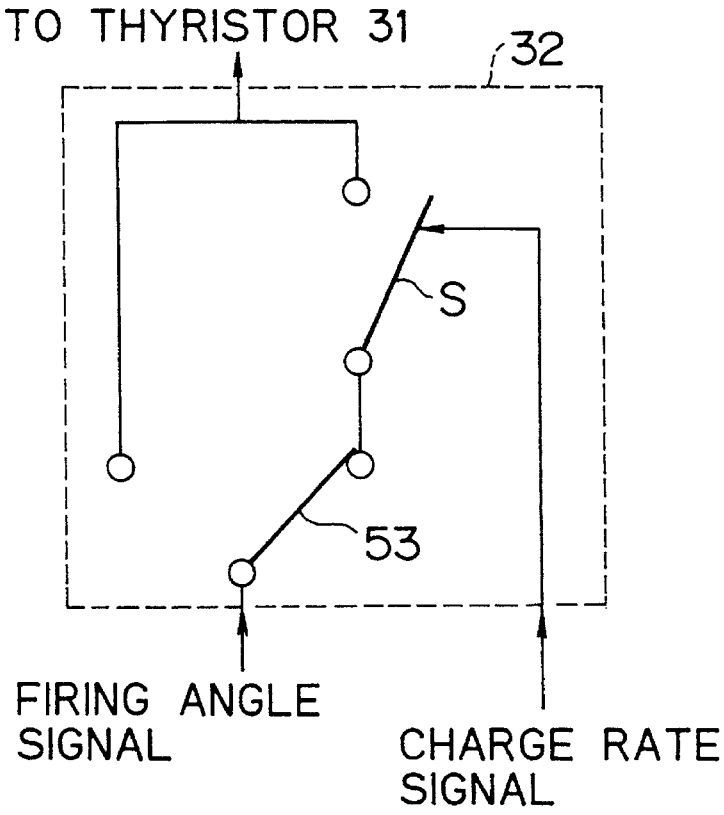
FIG. 5 is a schematic diagram illustrating another embodiment of the firing angle signal and the charge rate signal in the second embodiment.

Further, the second switch 53 is configured to cut off the supply path of the charge rate signal, while as shown in FIG. 5 the controller 32 may be divided into the circuit function for the intermittent charge and the circuit function for the continuous charge and any circuit may be selected by the switch 53.

The operation for turning on or off the switch S in FIG. 5 is the same as that of the switch in FIG. 4.

We claim:

1. An electric dust collector which superposes a pulse voltage of negative polarity produced by a pulse power supply circuit on a base voltage of negative polarity produced by a base power supply circuit, so that the two voltages are added to each other in the same direction of polarity and which supplies the superposed voltage to a discharge electrode of negative polarity disposed in a dust collection chamber connected to ground, comprising a capacitor having one end connected to the ground and the other end connected through a secondary winding of a pulse transformer to said discharge electrode, a positive voltage side output terminal of said base power supply circuit being connected to the ground side terminal of said capacitor, a negative voltage side output terminal of said base power supply circuit being connected through a smoothing circuit to the discharge electrode side terminal of said capacitor, and an output terminal of said pulse power supply circuit being connected to a primary winding of said pulse transformer.

2. An electric dust collector according to claim 1, wherein said pulse power supply circuit comprises: a series discharge circuit including a switching element, a saturable reactor, and a pulse capacitor which is charged by a DC source and which supplies a pulse discharge current to said primary winding of said pulse transformer; and a semiconductor element which is connected in parallel to said switching element and allows a current only in a direction reverse to that of the discharge current, wherein said switching element comprises a semiconductor element capable of being controlled to be turned on and off by a conductive control signal supplied to a control terminal of the switching element.

3. An electric dust collector according to claim 2, wherein said DC source includes a rectifier for rectifying a high-frequency AC voltage which has been converted into a desired high-frequency voltage by a converter circuit and an invertor circuit and boosted by a transformer.

4. An electric dust collector according to claim 1, wherein said pulse power supply circuit comprises a converter circuit for converting an AC voltage into a DC voltage, an invertor circuit for converting said converted DC voltage into a desired high-frequency AC voltage, a transformer for boosting said high-frequency AC voltage, a rectifier for rectifying said boosted high-frequency AC voltage, and a pulse capacitor charged with said rectified DC voltage and for supplying a pulse discharge current to said primary winding of said pulse transformer.

5. An electric dust collector according to claim 1, wherein said pulse power supply circuit comprises a series discharge circuit including a switching element, a saturable reactor, and a pulse capacitor which is charged by a DC source and which supplies a pulse discharge current to said primary winding of said pulse transformer, and a first switch for turning on or off a supply path of a conductive control signal supplied to a control terminal of said switching element; and said base power supply circuit comprises reverse-blocking triode thyristors connected in parallel to each other in the reverse direction between an AC power supply and a transformer, a second switch for switching a conductive control signal supplied to control terminals of said thyristors over to a continuous charging signal or an intermittent charging signal, and a rectifier for rectifying an AC voltage boosted by said transformer; wherein a third switch is provided for connecting said negative voltage side output terminal of said base power supply circuit to said discharge electrode either through said smoothing circuit, said capacitor and said secondary winding of said pulse transformer or directly by bypassing said smoothing circuit, said capacitor, and said secondary winding of said pulse transformer.

6. An electric dust collector according to claim 5, wherein said DC source includes a rectifier for rectifying a high-frequency AC voltage which has been converted into a desired high-frequency voltage by a converter circuit and an invertor circuit and boosted by a transformer.

7. An electric dust collector according to claim 1, wherein said pulse power supply circuit comprises a series discharge circuit including a switching element having a semiconductor element capable of being controlled to be turned on or off by a conductive control signal supplied to a control terminal of the semiconductor element, a saturable reactor, and a pulse capacitor which is charged by a DC source and which supplies a pulse discharge current to said primary winding of said pulse transformer, a semiconductor element which is connected in parallel with said switching element and allows a current only in a direction reverse to that of said discharge current, and a first switch for turning on or off a supply path of the conductive control signal supplied to the control terminal of said switching element; and said base power supply circuit comprises reverse-blocking triode thyristors arranged in parallel with each other in the reverse direction between an AC power supply and a transformer, a second switch for switching the conductive control signal supplied to control terminals of said thyristors over to a continuous charging signal or an intermittent charging signal, and a rectifier for rectifying an AC voltage boosted by said transformer; wherein a third switch is provided for connecting said negative voltage side output terminal of said base power supply circuit to said discharge electrode either through said smoothing circuit, said capacitor, and said secondary winding of said pulse transformer or directly by bypassing said smoothing circuit, said capacitor, and said secondary winding or said pulse transformer.

8. An electric dust collector according to claim 7, wherein said DC source includes a rectifier for rectifying a high-frequency AC voltage which has been converted into a desired high-frequency voltage by a converter circuit and an invertor circuit and boosted by a transformer.

* * * * *